United States Patent [19]

Simmons et al.

[11] 4,410,100

[45] Oct. 18, 1983

[54] BREATHER SEPARATOR FOR FLUID POWER SYSTEM RESERVOIR

[76] Inventors: James E. Simmons, 1209 Savannah Ct., Flower Mound, Tex. 75028; Bill Page, 3600 Valley View, 8-1, Irving, Tex. 75061

[21] Appl. No.: 317,164

[22] Filed: Nov. 2, 1981

[51] Int. Cl.[3] ..... B65D 25/20; B65D 51/16

[52] U.S. Cl. ..... 220/85 R; 137/1; 137/587; 220/373; 220/374

[58] Field of Search ..... 98/122; 137/1, 38, 587, 137/589, 582; 220/372, 373, 374, 85 R, 85

[56] References Cited

U.S. PATENT DOCUMENTS

| | | | |
|---|---|---|---|
| 1,056,842 | 3/1913 | Sharp | 220/374 X |
| 1,306,421 | 6/1919 | Feltz | 98/122 |
| 1,470,136 | 10/1923 | Bandino | 137/582 |
| 1,628,069 | 5/1927 | Schmidt et al. | 137/587 X |
| 2,354,795 | 8/1944 | Castle | 98/122 X |
| 2,494,679 | 1/1950 | Ward, Jr. | 220/372 |
| 4,285,440 | 8/1981 | Adams | 220/374 X |

FOREIGN PATENT DOCUMENTS

| | | | |
|---|---|---|---|
| 546742 | 7/1942 | United Kingdom | 98/122 |
| 579454 | 11/1977 | U.S.S.R. | 137/587 |

*Primary Examiner*—Allan N. Shoap
*Attorney, Agent, or Firm*—Robert G. Boydston

[57] ABSTRACT

A fluid separator is provided in the air venting apparatus of a fluid power system working fluid reservoir to separate and return to the reservoir working fluid droplets carried from the reservoir with air expelled through the venting apparatus.

2 Claims, 4 Drawing Figures

BREATHER SEPARATOR FOR FLUID POWER SYSTEM RESERVOIR

BACKGROUND OF THE INVENTION

Fluid power systems utilizing a petroleum oil as the working fluid are widely used on stationary and mobile industrial machinery. A basic fluid power system is comprised of a positive displacement fluid pump, a working piston in a cylinder, a fluid reservoir, interconnecting piping and a working fluid. Working fluid from the reservoir is pumped under pressure to the cylinder. The fluid pressure against a piston in the cylinder causes movement of the piston, thus converting some of the fluid pressure to work, and the spent fluid is returned to the reservoir. The reservoir is normally vented to ambient atmospheric pressure and the spent fluid, flowing under some pressure above atmospheric pressure, spews into the reservoir causing turbulence, and sometimes foaming, of the fluid in the reservoir. Reservoir air, displaced by the returning fluid, is vented to ambient atmosphere through a short standpipe capped by a steel wool packed breather cap similar to those used for venting automotive engine crankcases.

The turbulence in the reservoir fluid often results in working fluid being carried up the standpipe with the expelled air and out of the reservoir through the breather cap. Such breather caps are designed to inhibit the flow of dust and dirt contaminants into the reservoir but not to prevent the flow of fluid out through the cap. The fluid escaping the reservoir in this manner is wasted and causes equipment cleanliness problems.

On mobile construction machinery, transportation equipment and, particularly, fork lift trucks, the resulting oily mess is particularly undesirable. Machinery cleanliness is often essential, as where a fork lift truck is used in a clean warehouse or manufacturing facility. The mobile nature of such machines adds to the turbulence in the reservoir and increases the fluid spillage problem.

SUMMARY OF THE INVENTION

Our invention stops the upward flow of working fluid through a breather standpipe while allowing free flow of expelled air to ambient atmosphere. We found that, on a fork lift truck fluid power system, the amount of fluid moving through the standpipe at any one time is small, usually taking the form of droplets carried in the air stream. The cumulative effect of these small losses of fluid causes the equipment cleanliness problem and a significant loss of fluid from the system.

Our breather separator has an internal baffle that interrupts the flow of fluid droplets and splashes. The breather separator is used by interposing it in the standpipe between the main fluid reservoir and the breather cap. As a fluid bearing stream of air strikes the baffle, the fluid droplets flatten against and cling to the underside of the baffle because of surface tension. The fluid accumulates and flows smoothly down the curved underside surface of the baffle and down the inner wall of the standpipe to the reservoir while the expelled air flows around the baffle and out of the system to ambient atmosphere through the breather cap. On fork lift truck application experiments, prior fluid spillage problems were eliminated. The invention is suitable to produce the same result on any similar hydraulic system of stationary or mobile machinery.

These and other advantages of the invention will be more fully understood from the following description of a preferred embodiment taken together with the accompanying drawings.

DESCRIPTION OF THE PREFERRED EMBODIMENT

Figure 1:
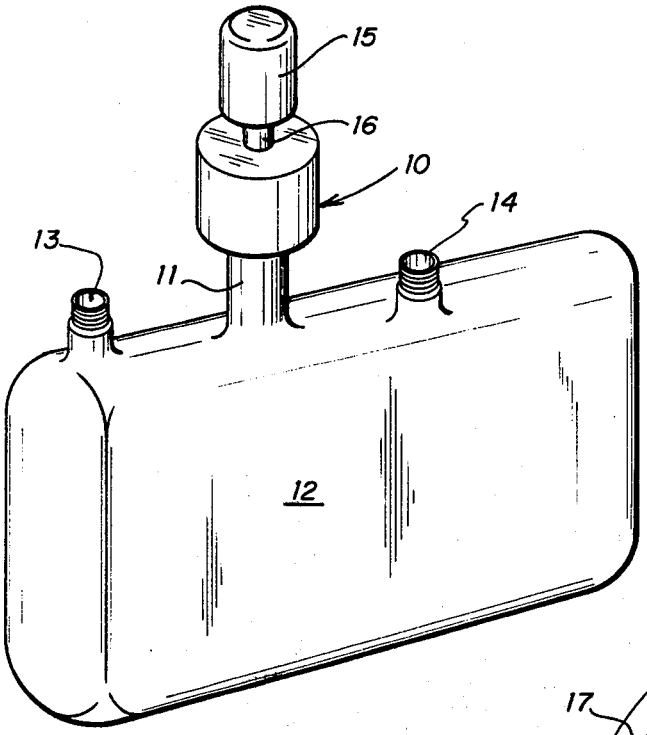
FIG. 1 is a simplified perspective view of a fluid power system fluid reservoir with the preferred embodiment of the present invention interposed between the reservoir and a conventional breather cap.
Figure 3:
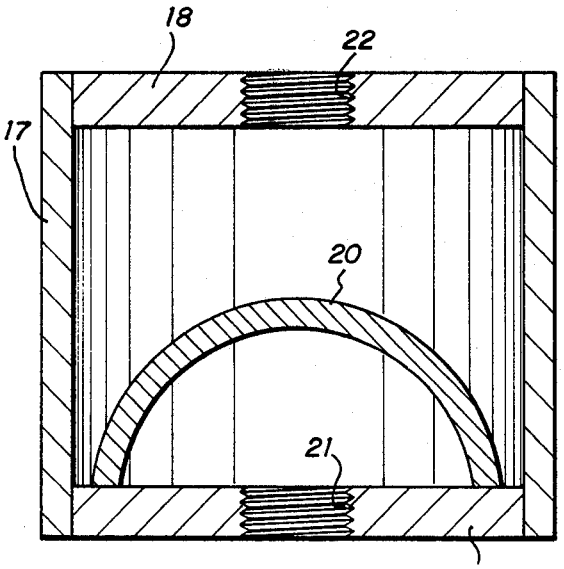
FIG. 3 is a cross-sectional view taken along the line 3—3 of FIG. 2.
Figure 4:
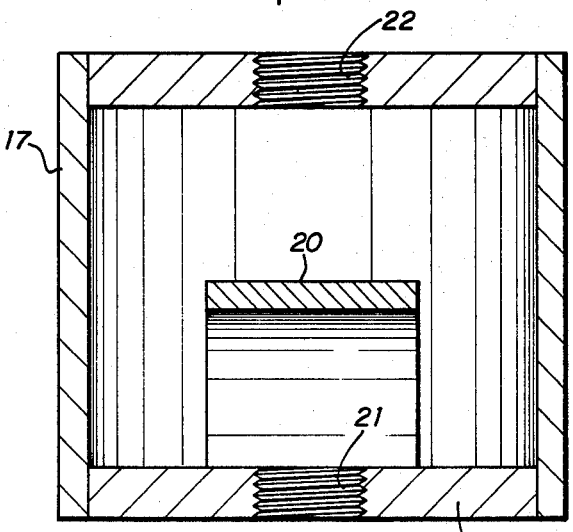
FIG. 4 is a cross-sectional view taken along the line 4—4 of FIG. 2.

In the drawing, the breather separator 10 of the preferred embodiment is shown in FIG. 1 in the form of cylindrical cannister affixed to a breather standpipe 11 on a fluid power system fluid reservoir 12. Working fluid is drawn from the reservoir 12 through an outlet connection aperture 13 and returned through an inlet connection aperture 14. The breather standpipe 11 usually is a standard pipe nipple in threaded engagement with the fluid reservoir 12 or it may be integrally welded to or formed into the reservoir as depicted. As shown in FIGS. 3 and 4, threaded hole 21 is provided in the bottom wall 19 for mounting the breather separator 10 to the standpipe 11, and another threaded hole 22 is provided in the upper wall 18 for affixing a separator outlet standpipe 16, in the form of another short pipe nipple, that appears in FIG. 1. A conventional breather cap 15, to prevent the entry of dust and dirt into the reservoir, is mounted atop the separator outlet standpipe 16 by spring clips or threaded engagement (not shown).

Figure 2:
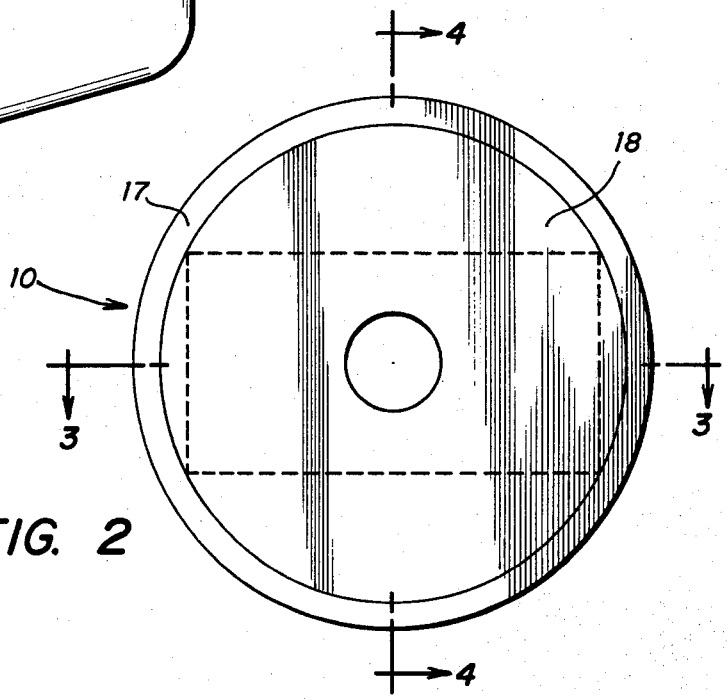
FIG. 2 is a top plan view of the breather separator.

It is obvious from the foregoing description that a venting passageway from the interior of the reservoir 12 to the ambient atmosphere is provided through the components described. Referring to FIGS. 2, 3, and 4, the breather separator 10 is comprised of a cannister formed by an outer cylindrical wall 17, a circular top wall 18 and a circular bottom wall 19, with such top and bottom walls glued or welded around their circumferences to the cylindrical wall 17. Thereby, the cylindrical cannister is completely enclosed but for the threaded holes 21 and 22. Positioned within the cannister directly over the threaded inlet hole 21 is an arched baffle plate 20, affixed by gluing or welding at each of its outer ends to the bottom wall 19.

Thus, upon the return of working fluid to the reservoir 12 through inlet aperture 14, air carrying fluid droplets is forced up the breather standpipe 11 and into the breather separator 10 through the inlet hole 21. As the air stream strikes the underside of the arched baffle 20, the fluid droplets cling by surface tension to the underside of the baffle, and flow by gravity down the arch back to the reservoir 12 through the breather standpipe 11, while the air stream diverts around the baffle and flows out to ambient atmosphere through the breather cap 15.

Whereas this invention is herein illustrated and described with respect to a particular embodiment, it should be realized that various changes may be made without departing from the essential contributions to the art made by the teachings hereof.

We claim:

1. An air venting apparatus for a fluid reservoir comprising, in combination, (a) a first conduit means connecting said reservoir to a fluid separation means;

(b) a fluid separation means comprised of a cylindrical cannister having an inlet aperture through a bottom flat wall, an outlet aperture through a top flat wall, an arched baffle member positioned inside the cylindrical cannister over the inlet aperture with a concave surface of the baffle member opposed to the inlet aperture, each end of the arched baffle member affixed to an upward facing surface of the flat bottom wall and an open space on each side of said baffle member allowing air flowing between the inlet and outlet openings to flow between said baffle and an interior wall of said cylinder;

(c) a second conduit means connecting said fluid separation means to a breather cap means; and (d) a breather cap means designed to inhibit the flow of dust from ambient atmosphere into the second conduit means.

2. The method for venting a fluid power system working fluid reservoir comprised of, in combination, (a) providing an air flow aperture in said reservoir;

(b) providing a first conduit means from said aperture to a fluid separation means disposed above the reservoir;

(c) providing said fluid separation means with a single internal baffle means for stopping an upward flow of fluid droplets while allowing upward and downward flow of air through the fluid separation means;

(d) providing a second conduit means from said fluid separation means to a dust particle separation cap; and (e) providing said dust particle cap to allow free flow of air from and into the second conduit means while preventing the flow of dust particles into the second conduit means;

(f) creating a downward fluid flow means by positioning the single internal baffle means above an upward facing opening of the first conduit means with a concave lower surface of the single internal baffle means directly opposed to the upward facing opening.

* * * * *